US009717318B1

(12) United States Patent
Zhang

(10) Patent No.: US 9,717,318 B1
(45) Date of Patent: Aug. 1, 2017

(54) MULTI-STAGE MASCARA APPLICATION OPERATION

(71) Applicant: Derik Zhang, Dongguan (CN)

(72) Inventor: Derik Zhang, Dongguan (CN)

(73) Assignee: Lava Industries Inc., Monterey Park, CA (US)

( * ) Notice: Subject to any disclaimer, the term of this patent is extended or adjusted under 35 U.S.C. 154(b) by 100 days.

(21) Appl. No.: 14/545,968

(22) Filed: Jul. 13, 2015

(51) Int. Cl.
*A45D 40/26* (2006.01)
*A45D 34/04* (2006.01)

(52) U.S. Cl.
CPC ..... *A45D 40/264* (2013.01); *A45D 40/262* (2013.01); *A45D 34/042* (2013.01); *A45D 34/043* (2013.01)

(58) Field of Classification Search
CPC combination set(s) only.
See application file for complete search history.

(56) References Cited

U.S. PATENT DOCUMENTS 5,339,841 A * 8/1994 Gueret ..... A45D 34/042 132/218
5,397,195 A * 3/1995 Goncalves ..... A45D 34/043 401/116
2005/0199256 A1* 9/2005 Bauer ..... A45D 40/265 132/218
2008/0112752 A1* 5/2008 Zhang ..... A45D 34/042 401/174
2012/0251220 A1* 10/2012 Byun ..... A46B 9/021 401/174

* cited by examiner

*Primary Examiner* — David Walczak
(74) *Attorney, Agent, or Firm* — William W. Haefliger

(57) ABSTRACT

Mascara dispensing apparatus comprising: a tubular container, a tubular piston movable endwise in the container and containing mascara, there being a chamber in the container through which the piston is movable and into which mascara flows via an outlet in the piston, mascara application brushes carried by the piston to receive mascara from the chamber as the piston moves endwise, the brushes movable by the piston to an exposed position for mascara application.

7 Claims, 5 Drawing Sheets

MULTI-STAGE MASCARA APPLICATION OPERATION

BACKGROUND OF THE INVENTION

This invention relates generally to dispensing of mascara in a simple, efficient manner, as from easily manually operable apparatus.

There is need for compact such apparatus, which repositions dispenser brushes in a concealed position in a container, and which automatically positions mascara externally for next usage of the apparatus. Another object is to provide improved, easily usable apparatus to provide such operation.

SUMMARY OF THE INVENTION

It is a major object of the invention to provide a self-operative, compact, improved, mascara dispenser easily operable by a user.

It is another object of the invention to provide such a dispenser apparatus, comprising:

a) a tubular container, b) a tubular piston movable endwise in the container, and containing mascara, c) a chamber in the container through which the piston is movable and into which mascara flows via an outlet in the piston, d) mascara application brushes carried by the piston to receive mascara from that chamber as the piston moves endwise, e) and the brushes movable by the piston to an external, exposed position, for mascara application.

A further object of the invention is to provide such a dispenser having an inlet to be exposed to mascara in the container, to receive mascara therefrom as the piston moves in one direction relative to the container, and also includes means to hold that inlet in a closed and sealed position, as during periods of non-use of the apparatus, and also having means to displace the piston to open the inlet in response to manual manipulation of the container.

Another object is to provide means including a screw threaded connection operatively connected between said piston and said container, and which is exposed to user manipulation after removal of a container cap.

Yet another object is to provide brushes that project generally radially away from the piston to wipe mascara from a surface defined by the chamber.

A further object includes provision of a piston as referred to above, that defines a tube filled with mascara between the inlet and said outlet, and wherein the piston remains filled with mascara between said inlet and outlet during piston travel endwise to locate the brushes outside the container.

These and other objects and advantages of the invention, as well as the details of an illustrative embodiment, will be more fully understood from the following specification and drawings, in which:

DRAWING DESCRIPTION

DETAILED DESCRIPTION

Figure 4:
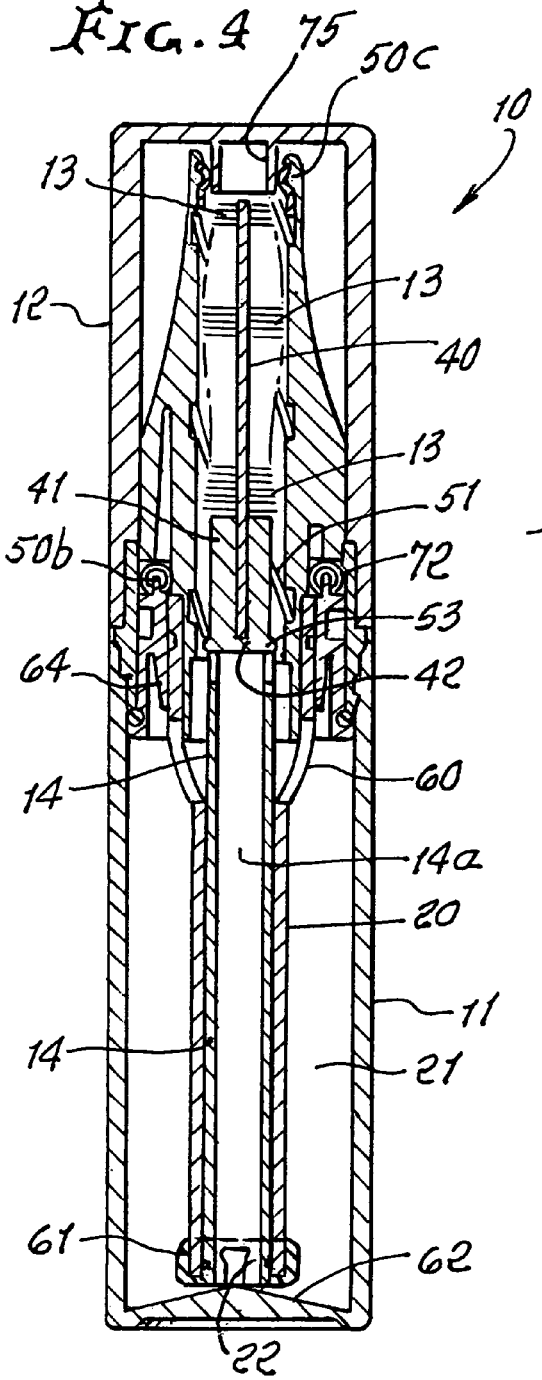
FIG. 4 is a vertical section taken on lines 4-4 of FIG. 1 showing a retracted view of a tubular piston.
Figure 2:
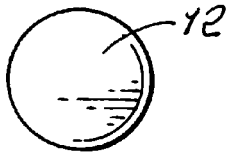
FIG. 2 is a top plan view of FIG. 1.
Figure 1:
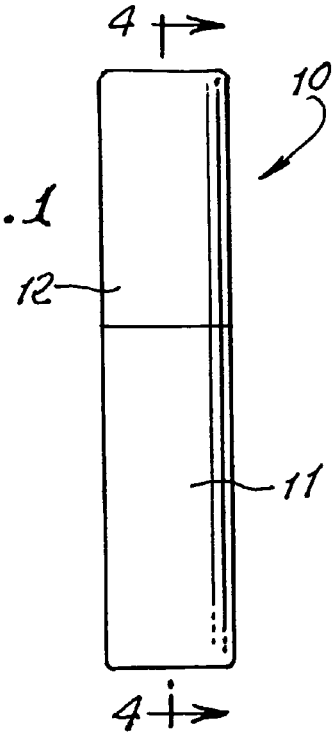
FIG. 1 is a side elevation view of apparatus embodying the invention.
Figure 3:
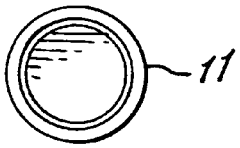
FIG. 3 is a bottom plan view of FIG. 1.
Figure 5:
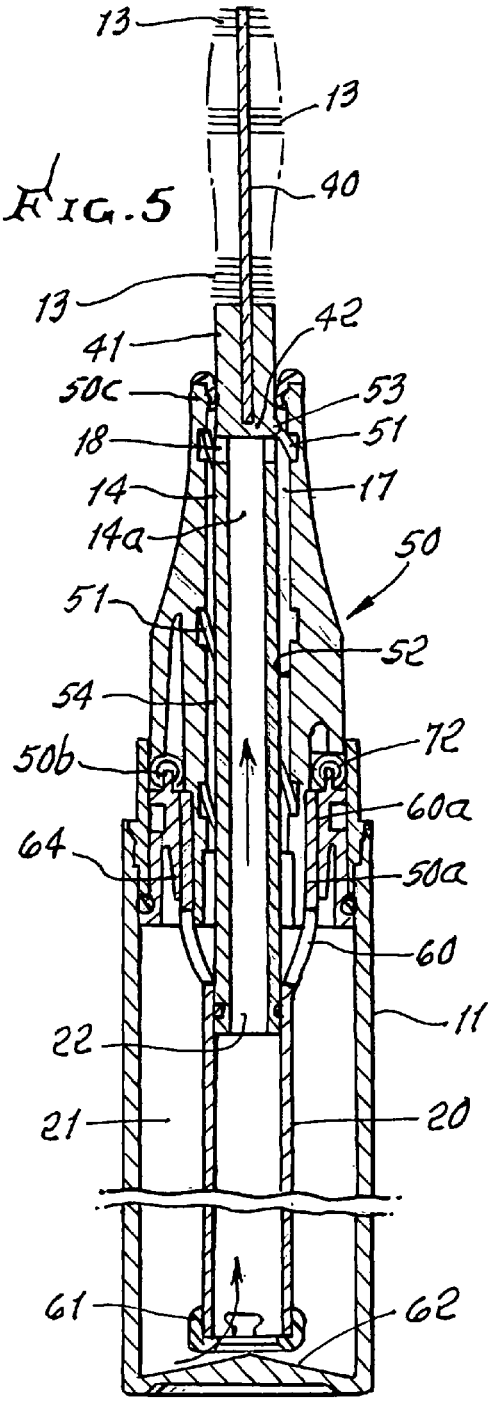
FIG. 5 is like FIG. 4, but showing an extended view of the tubular piston, with a bottom inlet to the piston, in open position.
Figure 6:
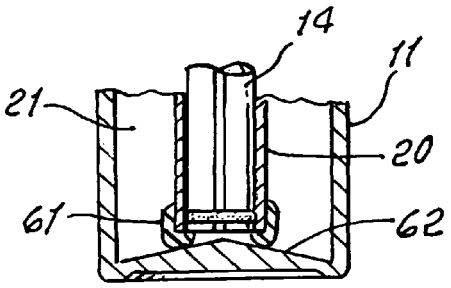
FIG. 6 is a fragmentary view of the bottom inlet, in closed position.

The mascara dispensing apparatus 10 shown in FIGS. 1-4 includes a tubular container 11 having a cap 12 that is removable, for dispensing of mascara, as via brushes 13 shown in FIG. 5. As will be seen, mascara is delivered via interior 14*a* of a tubular piston or plunger 14, movable endwise in the container, as between a down position shown in FIG. 4 and an elevated position shown in FIG. 5, for exposure of the brushes. Mascara is received by the brushes from an endwise elongated chamber 17 past which the brushes sweep as the piston is displaced endwise. The mascara is flowable into chamber 17 via a side outlet opening 18 in the piston, seen in FIGS. 4, 5, 13, and 15, for example during piston movement in a cylindrical receptacle 20 which is also endwise movable to limited extent, as seen in FIGS. 5 and 6. As the piston moves downward, mascara flows upwardly in the piston interior, from space 21 and via inlet 22 at the piston lower end, toward and through outlet 18, to chamber 17 Mascara storage space 21 is formed between container 11 and receptacle 20. As the piston moves upwardly, brushes are elevated and they wipe sidewardly against mascara in chamber 17, to externally present the mascara as in FIG. 5 position, for facial application by the user.

As seen in FIGS. 4 and 5, the brushes are carried by, and project sidewardly in opposite directions, from an upright strut 40 anchored to a support 41. That support is in turn, attached at 42 to the upper end of the piston.

The piston is driven in an endwise direction in response to clockwise manual twisting of a driver 50 relative to the container 11; and is driven in the opposite endwise direction in response to counterclockwise twisting of the driver 50 relative to container 11. For this purpose, note endwise spiral grooving 51 in the bore 52 of the driver, and note spiral follower 53 extending in the grooving and frictionally against outer surface 54 of the piston. Such twisting and also elevation serves to lift the cup 60 and the container 20 as to FIG. 5 position, opening the inlet 22 by lifting seal ring 61 off the upwardly tapered surface 62 defined by the bottom end of the container 11, i.e. to FIG. 5 position. This allows inflow of mascara to the container and to inlet 22 of the piston. The upper annular end wall 60*a* of the cup 60 fits between annular lower end extent 50*a* of driver 50, and a centering ring 64.

Figure 7:
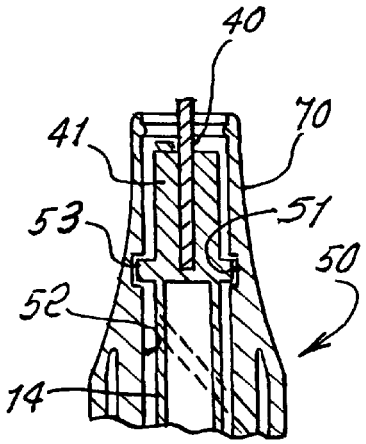
FIG. 7 is a fragmentary enlarged view of a top portion of the upwardly extended piston.
Figure 9:
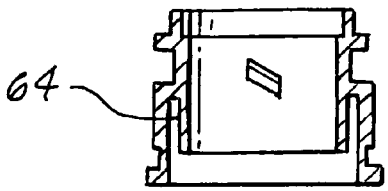
FIG. 9 is a vertical section taken through the FIG. 8 structure.
Figure 8:
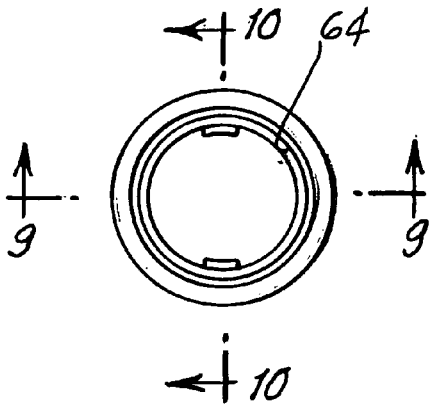
FIG. 8 is a cross sectional view taken through structure associated with the upwardly extended piston.
Figure 10:
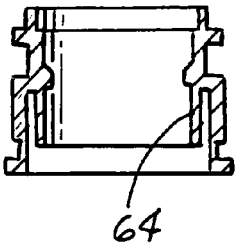
FIG. 10 is another vertical section taken through the FIG. 8 structure.
Figure 11:
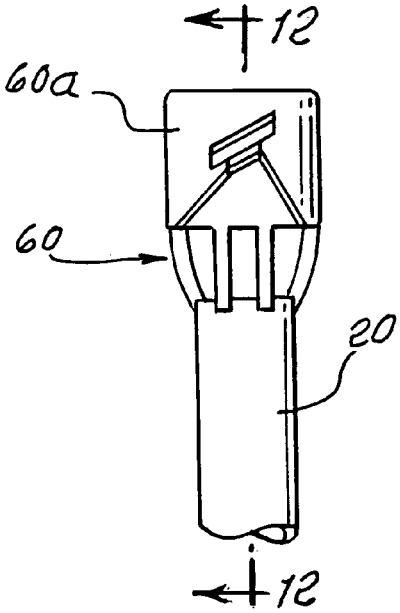
FIG. 11 is a fragmentary view of a housing through which the piston travels as it is elevated.
Figure 12:
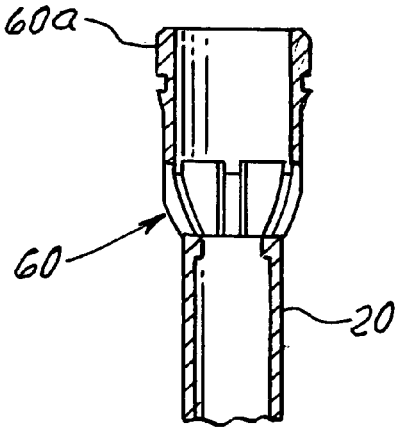
FIG. 12 is a vertical section taken through FIG. 11.
Figure 14:
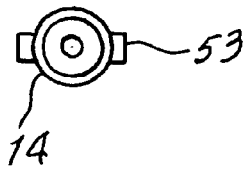
FIG. 14 is a horizontal view of the top end of the piston.
Figure 13:
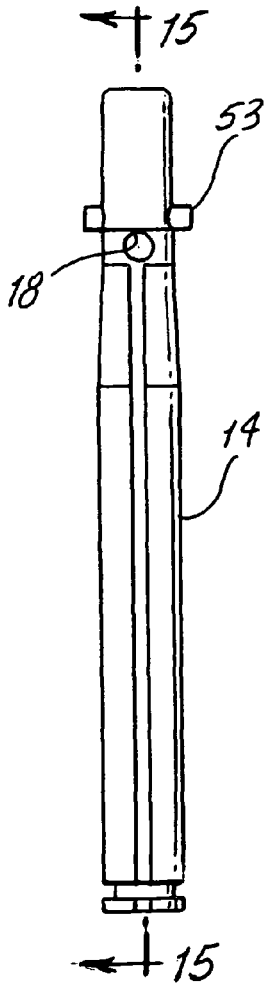
FIG. 13 is an elevation side view of the piston.
Figure 15:
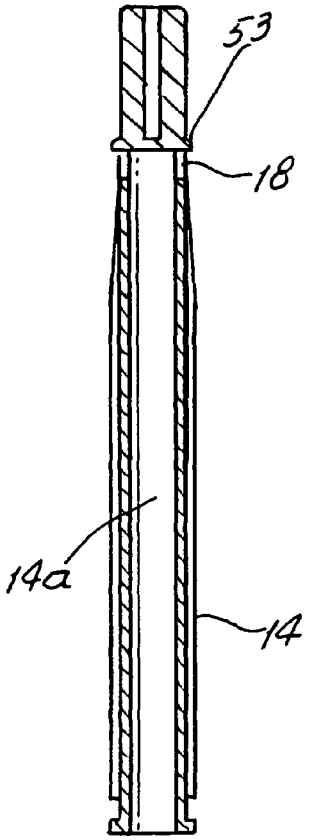
FIG. 15 is a section taken on lines 15-15 of FIG. 13.
Figure 16:
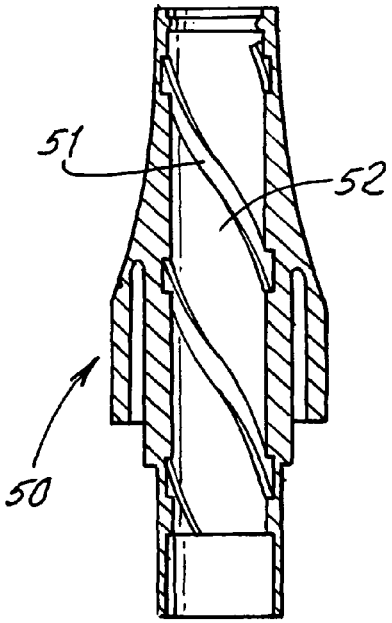
FIG. 16 is an elevation view taken in section of the top end of a piston tubular container, showing internal spiral guide grooving to receive a wiper that engages a mascara dispenser side wall as the piston travels endwise.
Figure 17:
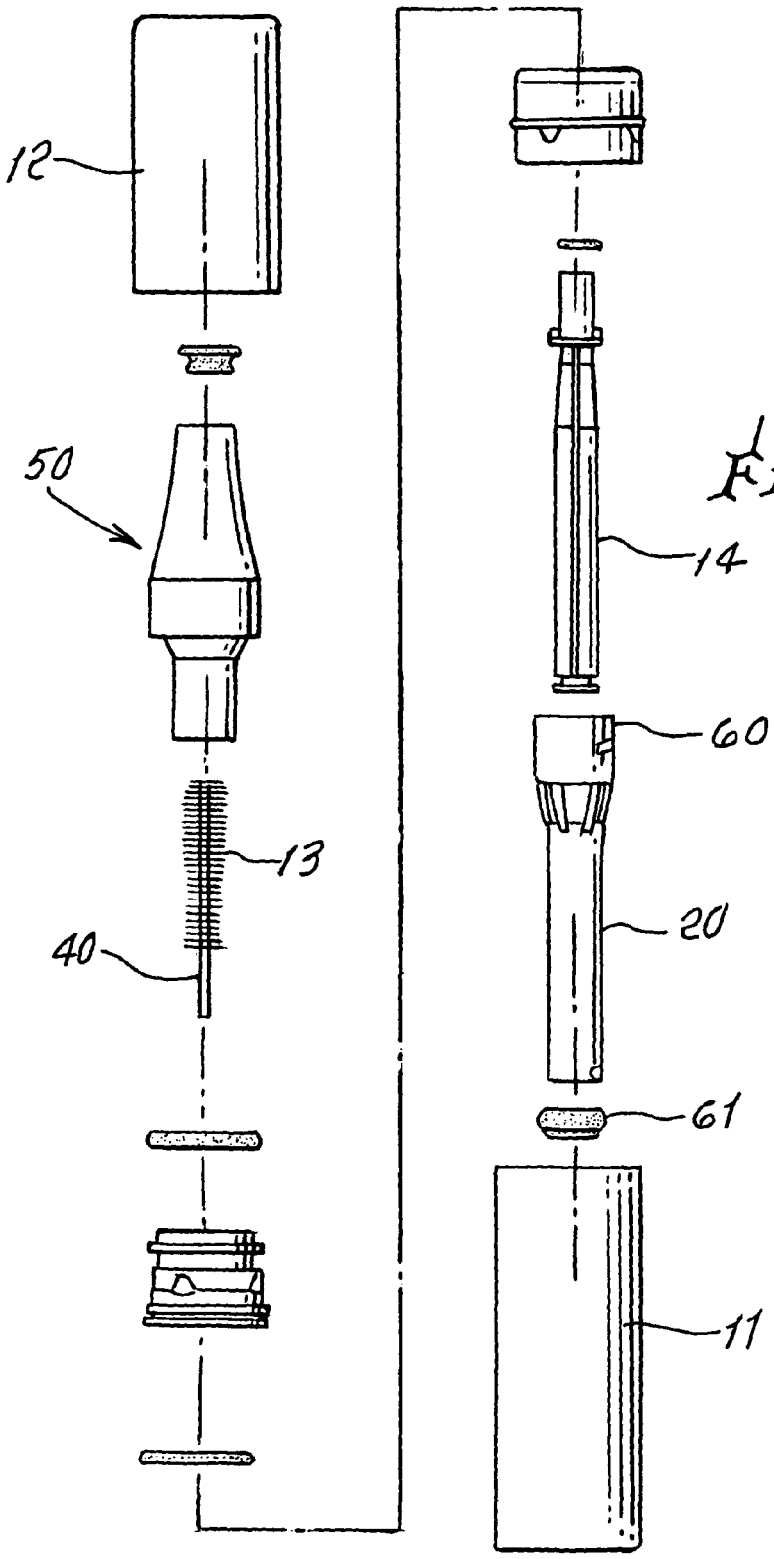
FIG. 17 is an exploded elevation view of device elements.

FIG. 6 shows the seal ring 61 downwardly sealing against surface 62. FIG. 7 shows anchoring of strut 40 in structure 41, within tapered upper end 70 of the driver 50. A ring shaped spacer 72 is located between driver 50 lower end 50*b* and ring 64.

In FIG. 4, the upper tubular end 50*c* of the driver seals against tubular walls 75 carried by the cap, to seal off against escape of mascara.

I claim:

1. Mascara dispensing apparatus comprising:

a) a tubular container, b) a tubular piston movable endwise in the container, and containing mascara, c) there being a chamber in the container through which the piston is movable and into which mascara flows via an outlet in the piston, d) mascara application brushes carried by the piston to receive mascara from said chamber as the piston moves endwise, e) the brushes movable by the piston to an exposed position, for mascara application, f) and wherein the piston has an inlet to be exposed to mascara in the container, to receive mascara therefrom as the piston moves in one direction relative to the container, including means to hold said inlet in a closed and sealed position, as during periods of non-use of the apparatus, g) said means including structure operatively connected between the piston and a twistable driver projecting in a cap in closed position of said apparatus to elevate the piston and brushes in response to twisting of the driver.

2. The combination of claim 1 wherein said inlet and said brushes are located at opposite ends of said piston.

3. The combination of claim 2 wherein said means includes a screw threaded connection operatively connected between said piston and said container.

4. The combination of claim 1 wherein said brushes project generally radially away from the piston to wipe mascara from a surface defined by the container.

5. The combination of claim 1 wherein the piston defines a tube filled with mascara between said inlet and said outlet.

6. The combination of claim 1 wherein the tubular piston remains filled with mascara between said inlet and outlet during piston travel endwise to locate said brushes outside the container.

7. The combination of claim 1 wherein the driver has an inner surface to secure mascara transferred to the brushes as the piston is elevated.

* * * * *